United States Patent [19]

Sinn

[11] Patent Number: 4,908,760

[45] Date of Patent: Mar. 13, 1990

[54] SELF-CLEANING OVEN TEMPERATURE CONTROL HAVING MULTIPLE STORED TEMPERATURE TABLES

[75] Inventor: Richard E. Sinn, St. Joseph Township, Berrien County, Mich.

[73] Assignee: Whirlpool Corporation, Benton Harbor, Mich.

[21] Appl. No.: 140,042

[22] Filed: Dec. 31, 1987

[51] Int. Cl.[4] ..... H05B 1/02

[52] U.S. Cl. ..... 364/400; 364/571.07; 219/413; 219/494; 219/497; 374/1

[58] Field of Search ..... 364/400, 557, 571.01, 364/571.02, 571.03, 571.04, 571.05, 571.07, 571.08; 219/413, 494, 497, 501, 508; 374/1

[56] References Cited

U.S. PATENT DOCUMENTS

| | | | |
|---|---|---|---|
| 4,369,352 | 1/1983 | Bowles | 219/413 |
| 4,482,261 | 11/1984 | Dewey et al. | 374/181 |
| 4,615,014 | 9/1986 | Gigandet et al. | 364/557 |
| 4,623,976 | 11/1986 | Carp et al. | 364/571.07 |
| 4,761,539 | 8/1988 | Carmean | 364/571.04 |
| 4,775,777 | 10/1988 | Sinn | 219/413 |

*Primary Examiner*—Jerry Smith

*Assistant Examiner*—David M. Huntley

*Attorney, Agent, or Firm*—Mason, Kolehmainen, Rathburn & Wyss

[57] ABSTRACT

A microprocessor based self-cleaning oven temperature control system and method includes a plurality of preprogrammed look-up temperature tables stored in a read only memory (ROM) portion of the memory of the microprocessor. One of the tables is selected for use as a reference table; and the values therefrom are transferred to a random access memory (RAM) portion of the memory of the microprocessor. Upon each application of power to the oven, the microprocessor, during an initiation subroutine, determines from a digital input signal the type of oven that is present. The oven type input signal to the microprocessor may designate a nominal or factory calibrated oven or an oven that has been recalibrated during a field service call to operate at bake temperatures offset from nominal bake temperatures. After determining the particular oven type, values from the appropriate temperature look up table in ROM are immediately transferred to RAM for use as a reference temperature table in connection with each subsequent execution of the oven temperature control algorithm.

5 Claims, 1 Drawing Sheet

SELF-CLEANING OVEN TEMPERATURE CONTROL HAVING MULTIPLE STORED TEMPERATURE TABLES

BACKGROUND OF THE INVENTION

1. Field of the Invention

The present invention generally relates to temperature control systems and methods and, more particularly, to a new and improved self-cleaning oven temperature control system and method.

2. Description of the Prior Art

Self-cleaning ovens and temperature controls therefor are old and well known in the prior art as exemplified by United States Pat. Nos. 3,121,158; 3,122,626; 3,310,654; 3,327,094; 3,353,004; 3,569,670; 3,648,012; 3,738,174; 3,924,101; 4,166,268; 4,214,224; and 4,369,352. Conventionally, the bake temperature controls for many prior art self-cleaning ovens are capable of being recalibrated in service to compensate for oven components that deviate from design specifications or to accommodate individual user preferences. See, for example, the above-identified 3,569,670 patent and the 3,924,101 patent and the 4,369,352 patent. Some prior art temperature control systems for self-cleaning ovens are designed to maintain a constant clean temperature even though the bake temperatures have been recalibrated and offset by a predetermined amount from nominal values. Recalibration of the bake temperatures in other prior art systems necessarily affects the clean temperature.

The usual approach to achieving the offset of nominal bake temperatures during recalibration, particularly with respect to digital electronic microprocessor based oven temperature control systems, is to provide and continuously utilize, whether in hardware or software, a temperature offset signal for adjusting either a sensed oven temperature signal or a user provided desired temperature signal. Normally, each time a subroutine containing the temperature control algorithm is executed by the microprocessor in the oven temperature control system, the temperature offset signal is sensed and utilized to modify either the desired temperature signal or the sensed oven temperature signal to control the energization of the oven heating elements. In some cases, it may be more simple and direct to eliminate the need to access and utilize such an offset temperature signal each time the subroutine containing the temperature control algorithm is executed by the microprocessor.

SUMMARY OF THE INVENTION

An object of the present invention is to provide a new and improved self-cleaning oven temperature control system and method.

Another object of the present invention is to provide a new and improved digital electronic microprocessor based temperature control system and method for a self-cleaning oven having a plurality of preprogrammed, stored look-up temperature tables, one of which tables is selected for use as the reference temperature table by the microprocessor in executing a subroutine containing the temperature control algorithm. Upon each application of power to the electric range or oven, the microprocessor determines the type of oven, i.e., a nominal temperature oven or an oven recalibrated to run, for example, 7° F. or 14° F. or 21° F. warm or cool. After determining the oven type, an appropriate temperature table from a plurality of such tables (e.g., seven such tables in the above example) stored in a read only memory (ROM) portion of the microprocessor is selected and immediately transferred to a random access memory (RAM) portion of the memory of the microprocessor for use as a reference temperature table in connection with the oven temperature control algorithm. Specifically, the oven temperature control algorithm operates merely by comparing the user selected desired temperature signal with the sensed oven temperature signal, without necessitating modifying either of such signals by a third temperature offset signal during each execution of the temperature control algorithm. In this manner, the need for continuously utilizing a separate temperature offset signal each time the oven temperature control algorithm is executed is eliminated.

BRIEF DESCRIPTION OF THE DRAWING

The above and other objects, advantages and novel features of the present invention will become apparent from the following detailed description of a preferred embodiment of the present invention illustrated in the accompanying drawing wherein.

DESCRIPTION OF THE PREFERRED EMBODIMENT

Figure 1:
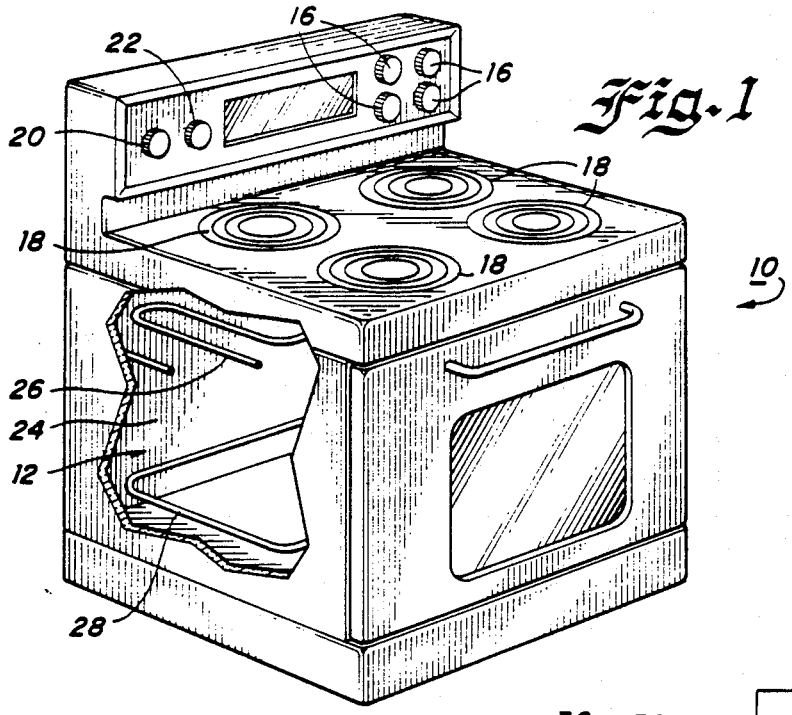
FIG. 1 illustrates a self-cleaning electric range having an oven adapted to be controlled by an oven temperature control system and method constructed in accordance with the principles of the present invention.
Figure 2:
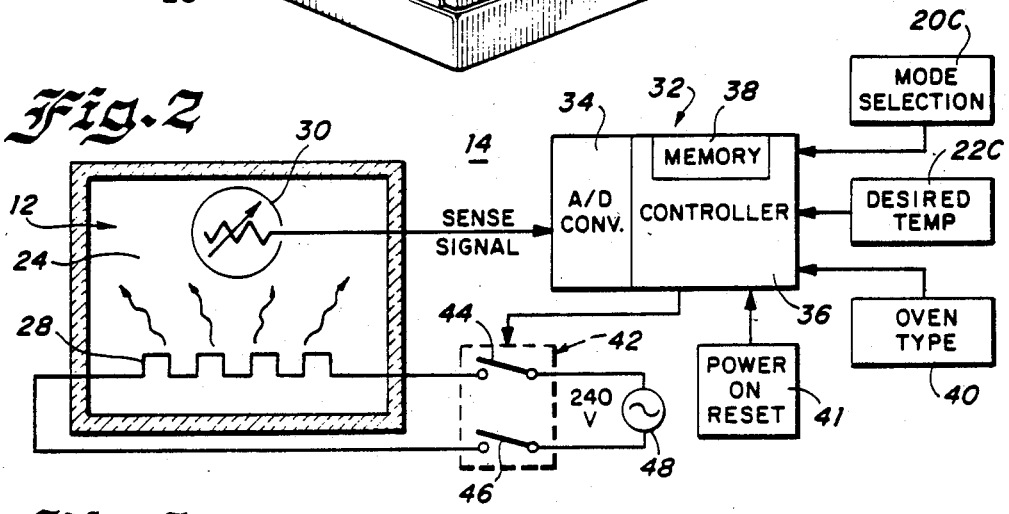
FIG. 2 is a schematic view of a digital electronic microprocessor based oven temperature control system constructed in accordance with the principles of the present invention.
Figure 3:
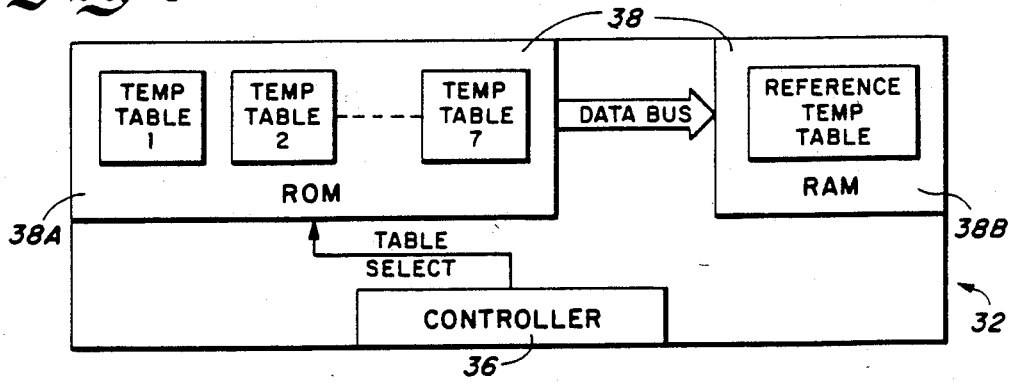
FIG. 3 is a schematic and functional view of a portion of the microprocessor based oven control system of FIG. 2.

Referring to the drawing and specifically to FIGS. 1–3 thereof, there is illustrated an electric range 10 having a self-cleaning oven 12 adapted to be controlled by a new and improved digital electronic microprocessor based control system 14 and method in accordance with the principles of the present invention. The range 10 includes a plurality of four control knobs 16 for respectively controlling a plurality of four conventional electric burners 18. In addition, the range 10 includes a control knob 20 for controlling the mode of operation of the oven 12, for example, the OFF mode, the BAKE mode, the BROIL mode and the CLEAN mode of operation. The range 10 also includes a control knob 22 to enable the desired oven temperature to be selected by the user of the oven 12. Disposed within a cavity 24 of the oven 12 are a conventional broiling element 26 and a conventional heating element 28. Finally, suitably positioned within the cavity 24 of the oven 12 is a conventional temperature sensor 30, for example, a standard oven temperature sensing probe. The control system 14 includes a conventional or commercially available, programmable microprocessor 32 capable of being suitably programmed to effect the desired control of the range 10 and of the oven 12. Conventionally, the microprocessor 32 includes an analog-to-digital (A/D) converter 34 for receiving, for example, analog voltage input signals from the temperature sensor 30 and for providing digital output pulses or signals to a controller section 36 within the microprocessor 32. The microprocessor 32 includes a memory 38 used in operating the control system 14. The memory 38 includes conventionally programmed operating instructions for the control system 14 and other data as discussed hereinafter. For example, a conventional, preprogrammed oven temperature control algorithm may be stored in the memory 38.

The control system 14 further includes an "oven type" circuit 40 for providing an input signal to the microprocessor 32 indicative of the type of oven 12 being controlled by the microprocessor 32. For example, the oven may be one operating with nominal bake temperatures or one whose bake temperatures have been recalibrated and offset by ±7° F. or ±14° F. or ±21° F. The input signal circuit 40 may take the form of three conventional digital input signals to the controller 36. A first one of the three digital input signals may be used to indicate a positive bake temperature offset when, for example, that input signal is low, or a negative bake temperature offset when, for example, that digital input signal is high. A second one of the three digital input signals may be used to indicate an offset of the bake temperatures of 7° F. when, for example, that input signal is high; and the third input signal may be used to indicate an offset of the bake temperatures of 14° F. when, for example, that input signal is high. In this manner, the circuit 40 indicates to the microprocessor 32 that the oven 12 is a specific one of the above seven different types.

The control system 14 also includes a "power on reset" circuit 41 for providing an input signal to the microprocessor 32 each time power is connected to the range 10 for operating the oven 12. Additionally, the control system 14 includes a power switching relay 42 that has a pair of relay contacts 44 and 46 for switching power to the heating element 28 from a constant voltage (e.g., 240 volts) source 48 of alternating current electric power under the control of the controller 36. For simplification, only the heating element 28 and the power relay 42 therefor have been illustrated in FIG. 2 in the control system 14. In an actual commercial embodiment, however, the broiling element 26 would obviously also be part of the control system 14 along with its own power switching relay to interconnect the broiling element 26 to the source 48 under the control of the controller 36. The broiling element 26 is used during the BROIL mode of operation of the oven 12 and may also be used in conjunction with the heating element 28 during the CLEAN and BAKE modes of operation of the oven 12 to provide sufficient heat to the oven 12 under the control of the controller 36.

During the BAKE mode of operation, the heating element 28 is energized by the source 48 through the relay 42 under the control of the controller 36 to heat and raise the temperature of items to be cooked within the oven cavity 24 of the oven 12. The oven temperature sensor 30, typically disposed within the oven cavity 24, provides an output analog voltage signal as an input to the A/D converter 34. That analog input signal is converted to a digital output signal that is supplied to the memory 38 and the controller 36 for controlling the ON-OFF state of the relay 42 and, thereby, the energization of the heating element 28.

As is conventional, a user of the range 10 selects by means of the control knob 20 the desired mode of operation of the oven 12, which mode selection is provided as an input signal to the microprocessor 32 by a conventional "mode selection" circuit 20C. If the BAKE mode of operation of the oven 12 has been selected, the user also selects a desired BAKE temperature by means of the control knob 22, which desired temperature is also provided as an input signal to the microprocessor 32 by a conventional "desired temperature" circuit 22C. The microprocessor 32 then, through the controller 36, controls the state of the power relay 42 to energize or deenergize the heating element 28 as a function of the actual oven temperature as sensed by the sensor 30 and of the desired temperature as provided by the desired temperature circuit 22C. The broiling element 26 may be similarly controlled to provide additional heat during the BAKE mode.

Occasionally, as a result of the desires of the user or a variation in or degradation of the performance of one or more oven components, the bake temperatures and, possibly, the self-cleaning temperature of oven 12 may require recalibration, typically during a field service call. Typically, such recalibration involves providing a temperature offset input signal to the microprocessor 32 for use each time a subroutine containing the oven temperature control algorithm is executed by the microprocessor 32. The temperature offset signal resulting from the recalibration normally is used to modify the actual value of either the user selected desired temperature or the sensed oven temperature.

In accordance with the an important feature of the present invention, a plurality of preprogrammed temperature look-up tables (FIG. 3) are stored in a read only memory (ROM) portion 38A of the memory 38. If, in accordance with the illustrative example discussed above, the oven 12 is capable of assuming one of seven different oven types as indicated by the "oven type" circuit 40, the ROM 38A would contain seven different look-up tables. For example, a first look-up table may contain values for use by the oven temperature control algorithm corresponding to the user selected desired temperature values capable of being used during the BAKE mode of operation of a nominal or factory calibrated oven 12. In addition, if desired, a value may be stored in the first lookup table corresponding to the self-cleaning temperature for use in the CLEAN mode of operation of such an oven 12. The six remaining look-up tables in the ROM 38A would each contain different values for the same user selected desired temperatures and, if desired, self-cleaning temperature respectively corresponding to each of the above six ways in which the oven 12 may be recalibrated, i.e., ±7° F. or ±14° F. or ±21° F.

After a recalibration operation and the reapplication of power to the range 10 for use in energizing the oven 12, the "power on reset" circuit 41 provides a reset signal to the microprocessor 32, causing the microprocessor 32 to execute an initiation subroutine. In that subroutine, the particular oven type of the oven 12 is determined by examining the input signal from the "oven type" circuit 40. Upon determining whether or not a recalibration of the oven 12 has occurred and, if so, the particular type of recalibration that has been performed, the microprocessor 32 through the controller 36 selects a set of values from the appropriate look-up table stored in the ROM 38A and transfers that set of values via a data bus to a random access memory (RAM) portion 38B of the memory 38 for storage therein as the current reference temperature table. The values stored in the reference temperature table of the RAM 38B. are those that are continuously used in the oven temperature control algorithm for controlling the operation of the oven 12. The initiation subroutine is performed each time power is applied to the range 10 for operating the oven 12. The actual values stored in the look-up tables in the ROM 38A and subsequently used in the reference temperature table in the RAM 38B may correspond, as desired, to values for either the sensed oven temperature signal from the oven temperature sensor 30 or the user selected desired temperature signal from the "desired temperature" circuit 22C. Importantly, the temperature control algorithm executed by the microprocessor 32 operates merely by comparing a value from the reference temperature table then in the RAM 38B associated with the magnitude of one of the above-mentioned two input signals and compares that value with the other of the two input signals, thereby eliminating the necessity of modifying one of the two input signals, after recalibration of the oven 12, by a temperature offset signal during each execution of the temperature control algorithm.

Obviously, many modifications and variations of the present invention are possible in light of the above teachings. While for the sake of simplicity, the controls 16, 20 and 22 are depicted in FIG. 1 as rotatable control knobs, those controls may obviously assume other conventional forms, such as touch sensitive electronic switches or switch panels. Thus, it is to be understood that, within the scope of the appended claims, the invention may be practiced otherwise than as specifically described hereinabove.

What is claimed and desired to be secured by Letters Patent is:

1. A self-cleaning oven comprising an oven cavity adapted to receive items to be cooked by said oven, heating means within said oven for raising the temperature of said oven cavity and control means for controlling the operation of said oven in a BAKE mode of operation and in a CLEAN mode of operation, said control means including oven cavity sensing means for sensing the temperature of said oven and also including desired temperature indicating means for indicating the user selected desired oven cavity bake temperature from a range of bake temperatures and also including automated means for automatically controlling the operation of aid heating means in said BAKE and CLEAN modes of operation, said automated means including memory means for storing a plurality of look-up tables, each of said tables including a unique set of values corresponding either to oven cavity temperatures expected to be detected by said sensing means or to said range of bake temperatures, said memory means including first memory means for storing said plurality of look-up tables and also including alterable memory means for receiving and storing one of said look-up tables for use by a microprocessor in automatically controlling the operation of said heating means in said BAKE mode, said control means further including settable means for indicating to said automated means a particular recalibrated oven type from a plurality of different recalibrated oven types, the number of said plurality of look-up tables being at least equal to the number of said plurality of recalibrated oven types, said automated means further including said microprocessor for automatically controlling the operation of said heating means in said BAKE mode in response to input signals from said sensing means and from said desired temperature indicating means and from said settable means, said one of said look-up tables being determined by the state of said settable means.

2. A self-cleaning oven as recited in claim 1 wherein said control means further includes reset circuit means for providing a signal to said microprocessor to execute an initiation subroutine each time power is applied to said oven for use by said heating means in raising the temperature of said oven cavity, said initiation subroutine including the transfer of said one of said look-up tables from a real-only-memory included memory means to said alterable memory means.

3. A self-cleaning oven as recited in claim 1 wherein the number of said plurality of different recalibrated oven types is at least six.

4. A self-cleaning oven as recited in claim 3 wherein the number of said plurality of said look-up tables is at least seven.

5. A self-cleaning oven comprising heating means within the oven for raising the internal temperature of said oven and control means for controlling the operation of said oven in a BAKE mode of operation and in a separate CLEAN mode of operation, said control means including oven temperature sensing means for sensing the internal temperature of said oven and also including desired temperature indicating means for indicating the user selected desired oven bake temperature from a range of bake temperatures and also including automated means for automatically controlling the operation of said heating means in said BAKE and CLEAN modes of operation, said automated means including a microprocessor having memory means for storing a plurality of different look-up tables and an oven temperature control algorithm for automatically controlling the operation of said oven in said BAKE mode of operation, one of said plurality of look-up tables being used by said microprocessor each time said oven temperature control algorithm is executed by said microprocessor, said control means further including means for indicated to said microprocessor a specific look-up table of said plurality of look-up tables to be used by said microprocessor in executing said oven temperature control algorithm, said look-up table indicating means having a plurality of states corresponding to a plurality of different recalibrated oven types, the number of said plurality of look-up tables being at least equal to the number of said plurality of different states, said memory means including first memory means for storing said plurality of said look-up tables, said memory means further including alterable memory means for storing said one of said look-up tables for use by said microprocessor in executing said oven temperature control algorithm, the values of one of said plurality of look-up tables being transferred from said first memory means to said alterable memory means in response to the receipt of a signal from said look-up table indicating means by said microprocessor.

* * * * *